US011232707B1

(12) United States Patent
Kulus et al.

(10) Patent No.: US 11,232,707 B1
(45) Date of Patent: Jan. 25, 2022

(54) INCIDENT-BASED TRAFFIC SIGNAL PREEMPTION AND PRIORITY

(71) Applicant: Global Traffic Technologies, LLC, St. Paul, MN (US)

(72) Inventors: Christian Kulus, New Brighton, MN (US); Chad Mack, Durand, WI (US); Jared Moore, Osprey, FL (US)

(73) Assignee: Global Traffic Technologies, LLC, St. Paul, MN (US)

( * ) Notice: Subject to any disclaimer, the term of this patent is extended or adjusted under 35 U.S.C. 154(b) by 0 days.

(21) Appl. No.: 17/242,977

(22) Filed: Apr. 28, 2021

Related U.S. Application Data

(62) Division of application No. 16/997,292, filed on Aug. 19, 2020, now Pat. No. 11,030,895.

(51) Int. Cl.

| | |
|---|---|
| ***G08G 1/087*** | (2006.01) |
| ***G08G 1/017*** | (2006.01) |
| ***G08G 1/083*** | (2006.01) |
| ***G08G 1/08*** | (2006.01) |

(52) U.S. Cl.
CPC ..... *G08G 1/087* (2013.01); *G08G 1/017* (2013.01); *G08G 1/08* (2013.01); *G08G 1/083* (2013.01)

(58) Field of Classification Search
CPC ..... G08G 1/087; G08G 1/08; G08G 1/017; G08G 1/083
See application file for complete search history.

(56) References Cited

U.S. PATENT DOCUMENTS

| | | | | |
|---|---|---|---|---|
| 8,823,548 | B2 * | 9/2014 | Johnson | G08G 1/081 340/906 |
| 9,934,685 | B1 * | 4/2018 | Bernhardt | G08G 1/005 |
| 2005/0104745 | A1 * | 5/2005 | Bachelder | G08G 1/07 340/906 |
| 2006/0095199 | A1 | 5/2006 | Lagassey | |

(Continued)

FOREIGN PATENT DOCUMENTS

WO 2017118996 A1 7/2017

OTHER PUBLICATIONS

USPTO/ISA. International Search Report and Written Opinion dated Jul. 27, 2021 for related international application of the common Applicant, PCT Application Serial No. PCT/US2021/028076, 8 pgs.

*Primary Examiner* — Ojiako K Nwugo
(74) *Attorney, Agent, or Firm* — Crawford Maunu PLLC

(57) ABSTRACT

Controlling traffic signal preemption includes inputting to a conditional preemption circuit, values of incident parameters that include at least a vehicle unit identifier of a vehicle unit and an incident priority that describes an incident. The conditional preemption circuit determines a vehicle class based on one or more of the plurality of incident parameters. In response to a preemption request communicated from the vehicle unit, the conditional preemption circuit determines whether or not the vehicle unit qualifies for preemption at one or more intersections based at least on the vehicle class, location of the vehicle, and heading of the vehicle unit specified in the preemption request. Phase selection signals are communicated to traffic signal control circuitry at the one or more intersections in response to determining that the vehicle unit qualifies for preemption at the one or more intersections.

16 Claims, 8 Drawing Sheets

(56) References Cited

U.S. PATENT DOCUMENTS

| | | | | |
|---|---|---|---|---|
| 2007/0008173 | A1* | 1/2007 | Schwartz | G08G 1/087 340/902 |
| 2007/0008174 | A1* | 1/2007 | Schwartz | G08G 1/087 340/902 |
| 2008/0316055 | A1 | 12/2008 | Bachelder et al. | |
| 2011/0109477 | A1* | 5/2011 | Edwardson | G08G 1/087 340/906 |
| 2011/0109478 | A1* | 5/2011 | Williamson | G08G 1/087 340/906 |
| 2011/0234423 | A1* | 9/2011 | Edwardson | G08G 1/087 340/906 |
| 2011/0304476 | A1* | 12/2011 | Johnson | G08G 1/07 340/906 |
| 2012/0218126 | A1* | 8/2012 | Roberts | G08G 1/087 340/906 |
| 2015/0088406 | A1 | 3/2015 | Blandin et al. | |
| 2015/0243165 | A1* | 8/2015 | Elsheemy | B60R 25/00 340/906 |
| 2015/0371538 | A1* | 12/2015 | Eichhorst | G08G 1/087 340/906 |
| 2017/0236412 | A1* | 8/2017 | Gross | G08G 1/087 701/301 |
| 2019/0176828 | A1* | 6/2019 | Weiser | G08G 1/096 |
| 2020/0211378 | A1* | 7/2020 | Umehara | G08G 1/087 |
| 2020/0365015 | A1* | 11/2020 | Nguyen | G08G 1/0133 |

* cited by examiner

INCIDENT-BASED TRAFFIC SIGNAL PREEMPTION AND PRIORITY

FIELD OF THE INVENTION

The disclosure generally describes methods and systems for initiating and prioritizing signal preemption and priority requests for controlling traffic signals.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making preemption requests to the intersection controllers that control the traffic lights at the intersections. The intersection controller may respond to the preemption request from the vehicle by changing the intersection lights to green in the direction of travel of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle and generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID, and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle are used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected in a first come, first served manner. A preemption request is issued to the controller for the approach direction with the highest priority vehicle travelling on it.

With metropolitan wide networks becoming more prevalent, additional means for detecting vehicles via wired networks, such as Ethernet or fiber optics, and wireless networks, such as cellular, Mesh or 802.11b/g, may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics reside. In this case, the vehicle or an intermediary reports, via the network, the vehicle's security information, location, speed and heading along with the current time on the vehicle, to centrally sited software and hardware systems or to intersection devices on the network. The vehicle information is evaluated using approach maps as described in the Opticom GPS system. The security coding could be identical to the Opticom GPS system or employ another coding scheme.

SUMMARY

A disclosed method includes inputting to a conditional preemption circuit, values of a plurality of incident parameters that include at least a vehicle unit identifier of a vehicle unit and an incident priority that describes an incident. The method includes determining by the conditional preemption circuit, a vehicle class based on one or more of the plurality of incident parameters. The method determines in response to a preemption request communicated from the vehicle unit, whether or not the vehicle unit qualifies for preemption at one or more intersections based at least on the vehicle class, location of the vehicle, and heading of the vehicle unit specified in the preemption request. The method includes communicating phase selection signals to traffic signal control circuitry at the one or more intersections in response to determining that the vehicle unit qualifies for preemption at the one or more intersections.

A disclosed system includes a computer system having one or more processors and memory configured with instructions that when executed cause the one or more processors to input values of a plurality of incident parameters that include at least a vehicle unit identifier of a vehicle unit and an incident priority that describes an incident. The one or more processors determine a vehicle class based on one or more of the plurality of incident parameters. The one or more processors determine, in response to a preemption request communicated from the vehicle unit, whether or not the vehicle unit qualifies for preemption at one or more intersections based at least on the vehicle class, location of the vehicle, and heading of the vehicle unit specified in the preemption request. The one or more processors communicate phase selection signals to traffic signal control circuitry at the one or more intersections in response to determining that the vehicle unit qualifies for preemption at the one or more intersections.

Other embodiments will be recognized from consideration of the Detailed Description and Claims, which follow.

BRIEF DESCRIPTION OF THE DRAWINGS

Various aspects and advantages of the disclosed embodiments will become apparent upon review of the following detailed description and upon reference to the drawings in which.

DETAILED DESCRIPTION OF THE DRAWINGS

Figure 1:
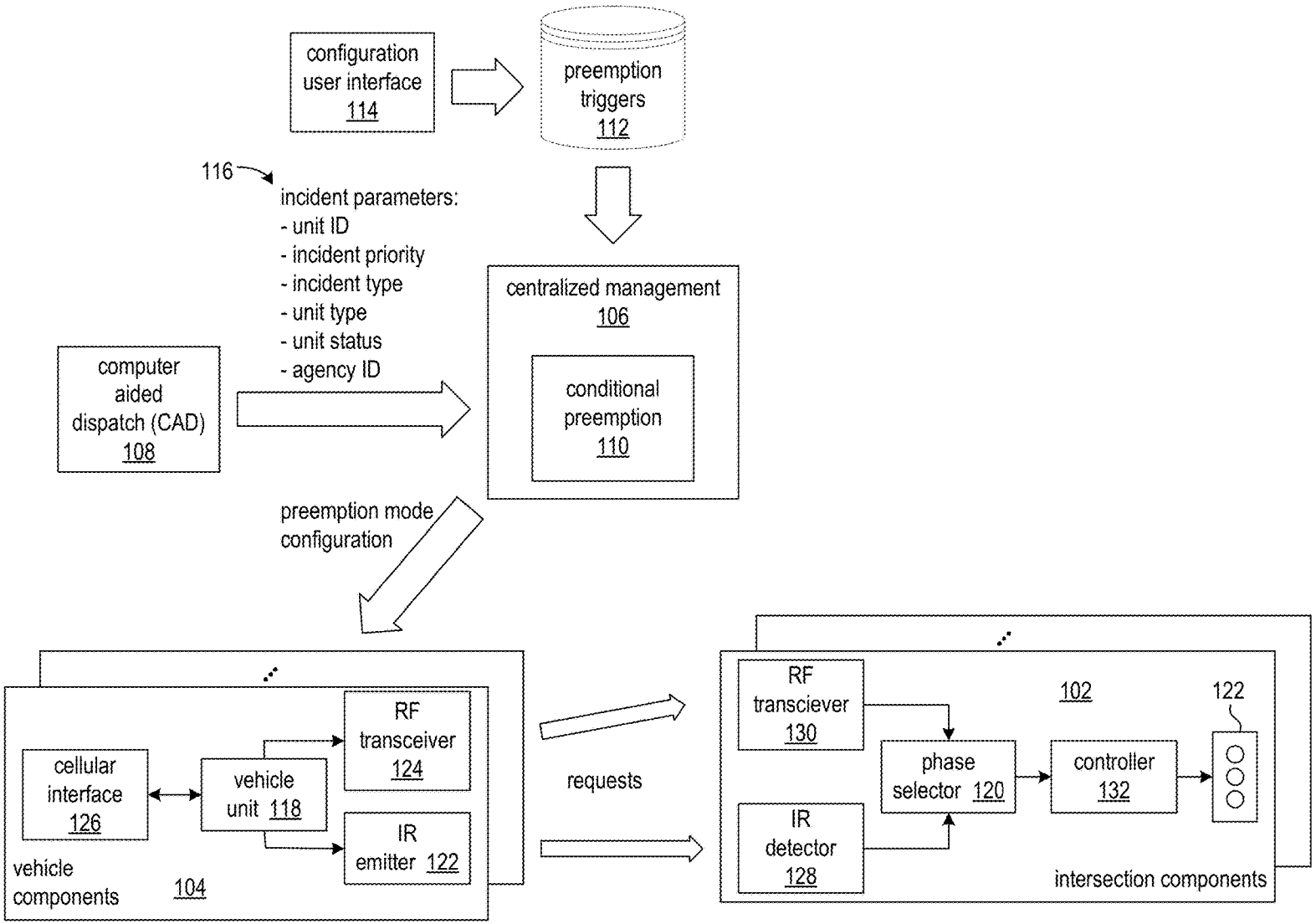
FIG. 1 shows a distributed approach for configuring traffic signal preemption modes of vehicles based on incident parameters.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element.

Equipment for controlling traffic signals at an intersection generally includes an intersection controller that cycles through the green, yellow, and red phases of a traffic light and a phase selector that receives identification and tracking information from vehicles. The phase selector determines when to submit a preemption or priority control request to the traffic controller based on the ETA and/or distance between the associated vehicle and the intersection. In response to a preemption or priority control request the intersection controller can deviate from timed phases and extend the duration of a green phase or truncate the duration of a red phase in order to reduce or eliminate the stop time at the intersection for associated vehicles.

The disclosed approaches for managing traffic signal preemption enable traffic signal preemption to be dynamically turned on and turned off, or preemption priority dynamically changed for individual vehicles. That is, in response to reporting of a first type of incident a vehicle (or class of vehicle) can be assigned one preemption priority, and in response to reporting of a second type of incident, the same vehicle (or vehicles in the same class) can be can be turned off or assigned a different preemption priority. For example, emergency vehicle preemption (EVP) can be turned on and turned off for a particular vehicle or class of vehicles based on an incident priority, an incident type, the status of a vehicle unit, and/or the type of vehicle carrying the vehicle unit. The vehicle unit can be an on-board vehicle computer that is programmed to initiate preemption requests according to the processes described herein.

Examples of different incidents can include general facility alarms, burglaries, crashes, general disturbances, domestic disturbances, fires, hazmat emergencies, and medical emergencies. When a dispatcher generates an incident report, a priority level can be assigned to the incident, and different priority levels can be used to trigger different preemption modes. Examples of vehicle types that may request preemption in responding to different incidents can include police squad cars, S.W.A.T vehicles, firefighting apparatus, hazmat vehicles, search and rescue vehicles, ambulances, public utility vehicles, tow trucks, etc. Preemption modes of non-emergency vehicles can also be dynamically configured based on incident parameters. For example, public transit vehicles and delivery vehicles can also have preemption modes changed in response to reports of non-emergency incidents.

According to the features of one method and system, incident parameters can be used to conditionally enable and disable different preemption modes for particular vehicle units. The preemption modes can include a high mode, which enables traffic signal preemption for a vehicle, and a probe mode, which effectively disables traffic signal preemption. An alternative to probe mode would be an explicit disable mode, which can prevent a vehicle from issuing requests or cause requests from a vehicle to be ignored. The high mode can enable generating of EVP requests. Different preemption modes can have different priorities for preempting traffic signals. For example, a transit signal priority (TSP) preemption mode can have a lower priority than an EVP mode, and a vehicle can have a TSP mode for some incidents and probe mode for other incidents.

According to the features of another method and system, the classification of a vehicle can be dynamically changed based on incident parameters, with preemption priority being affected by the vehicle classification. In response to incident parameters that include at least a vehicle unit identifier of a vehicle unit and an incident priority, a conditional preemption circuit determines a vehicle class to assign to the identified vehicle unit based on one or more of the incident parameters. In response to a preemption request communicated from or generated externally for a vehicle unit, the system determines whether or not the vehicle qualifies for preemption at one or more intersections based at least on the vehicle class, location of the vehicle, and heading of the vehicle specified in the preemption request. In response to determining that the vehicle qualifies for preemption at the one or more intersections, phase selection signals are communicated to traffic signal control circuitry, such as phase selectors and/or intersection controllers at the one or more intersections.

FIG. 1 shows a distributed approach for configuring traffic signal preemption modes of vehicles based on incident parameters. The system of FIG. 1 includes multiple arrangements of intersection components 102, multiple arrangements of vehicle components 104, a centralized management system 106, and a computer aided dispatch (CAD) system 108. The arrangements of intersection components can be disposed at respective intersections, and the arrangements of vehicle components 104 can be disposed in respective vehicles, such as emergency, transit, or delivery vehicles.

The arrangements of vehicle components 104 can be individually configured with a preemption mode, and the preemption mode can be dynamically determined and changed based on different incidents occurring at different times.

The desired preemption mode for an incident can be determined and changed by the conditional preemption module 110, which can be implemented as software that is part of the centralized management system 106. The centralized management system can be hosted on a computer system that has memory and storage circuitry, one or more processors configured to execute the software, and communication interfaces for communicating with vehicle components 104. The computer system can also have network interfaces for communicating with the CAD system 108.

The conditional preemption module 110 can be configured to evaluate incident parameters 116 relative to preemption triggers 112. The preemption triggers can be specified through a configuration user interface 114, which can be a component of the centralized management system. The preemption triggers can specify combinations of incident parameter values that when detected trigger configuration of different preemption modes for different vehicles. In an exemplary implementation, the incident parameters can include a unit identifier, an incident priority, an incident type, a unit type, a unit status, and an agency identifier. The unit identifier can uniquely identify the vehicle being dispatched and can include an address (e.g., IP address) for communicating with an arrangement of on-board vehicle components 104. The incident priority can indicate the degree of urgency with which the dispatched vehicle should proceed. The number of priority levels can vary according to implementation requirements. Exemplary incident types can include alarm, burglary, crash, disturbance, domestic disturbance, fire, hazmat, and medical. Exemplary unit types can include animal, detective, patrol, fire, EMS, as well as transit and delivery vehicles. Exemplary unit status can include available, unavailable, dispatched, en route, on scene, and off duty. Exemplary agency identifiers can include police, fire, and transit, for example.

In response to receiving an incident report from the CAD system 108, the conditional preemption module 110 evaluates the values of the incident parameters against the preemption triggers 112. In response to a preemption trigger matching the combination of incident parameter values, the conditional preemption module communicates a configuration message to the vehicle unit of one of the arrangements of vehicle components 104 as identified by the unit identifier specified in the incident report.

According to one implementation, the configuration message can specify either a high mode or a probe mode. In high mode, traffic signal preemption is enabled for the vehicle by way of the vehicle unit 118 issuing EVP requests. In probe mode, traffic signal preemption is effectively disabled for the vehicle by way of the vehicle unit 118 issuing probe requests. EVP requests are given priority by the phase selector 120 over other competing requests, such as transit signal priority (TSP) requests. Probe requests are not evaluated by the phase selector for interrupting phases of the traffic signals 122. Rather, for a probe request the phase selector logs data associated with the probe request, such as a date and time stamp, requester identifier, etc. By logging data and not interrupting the traffic signal phase in response to a probe request, preemption is effectively disabled.

In alternative implementations, one or more additional preemption modes can be provided to configure the vehicle unit 118. That is, the available preemption modes need not be limited to high mode and probe mode. Exemplary additional preemption modes could be a mode that configures the vehicle unit to issue TSP preemption requests and/or a mode that prevents issuing of requests by or for a vehicle.

Each arrangement of vehicle components 104 can include a vehicle unit 118, an infrared (IR) light emitter 123 and/or an RF transceiver 124. The arrangement can further include global positioning system (GPS) modules (not shown). The IR emitter can issue preemption requests encoded as IR signals for IR-based preemption controls consistent with recognized systems. The RF transceiver can issue preemption requests encoded as radio signals for GPS based preemption controls consistent with recognized systems. The preemption requests can be issued to one or more in-range intersections. Examples of the vehicle modules 123 and 124 are those of the OPTICOM emitter-based system and the OPTICOM GPS priority control system. The vehicle components can include a cellular communications interface 126, which is coupled to the vehicle unit 118, for communicating with the conditional preemption module 110.

The intersection components 102 can include IR detector circuitry 128 and/or radio transceiver circuitry 130. The IR detector receives IR-encoded preemption requests, and the RF transceiver receives RF encoded preemption requests. The preemption requests are evaluated and prioritized by the phase selector 120. The phase selector, which can be implemented on a microprocessor or as programmable logic, provides phase control signals to the intersection controller 132, which controls the phases (the phases including a green phase, a yellow phase, and a red phase, for example) of the traffic signals 122. The phase selector 120 can be configured to select one preemption candidate from a set of preemption candidates for signaling the intersection controller 132 to preempt the phases of the traffic signals. The selection of the preemption candidate is made based on a variety of factors such as relative priorities based on vehicle classifications, ages of the requests, and the approach of an in-progress preemption request in combination with the approaches associated with the preemption candidates.

As an alternative to the distributed approach to configuring preemption modes of vehicles as shown in FIG. 1, the preemption modes of vehicles can be centrally managed.

Figure 2:
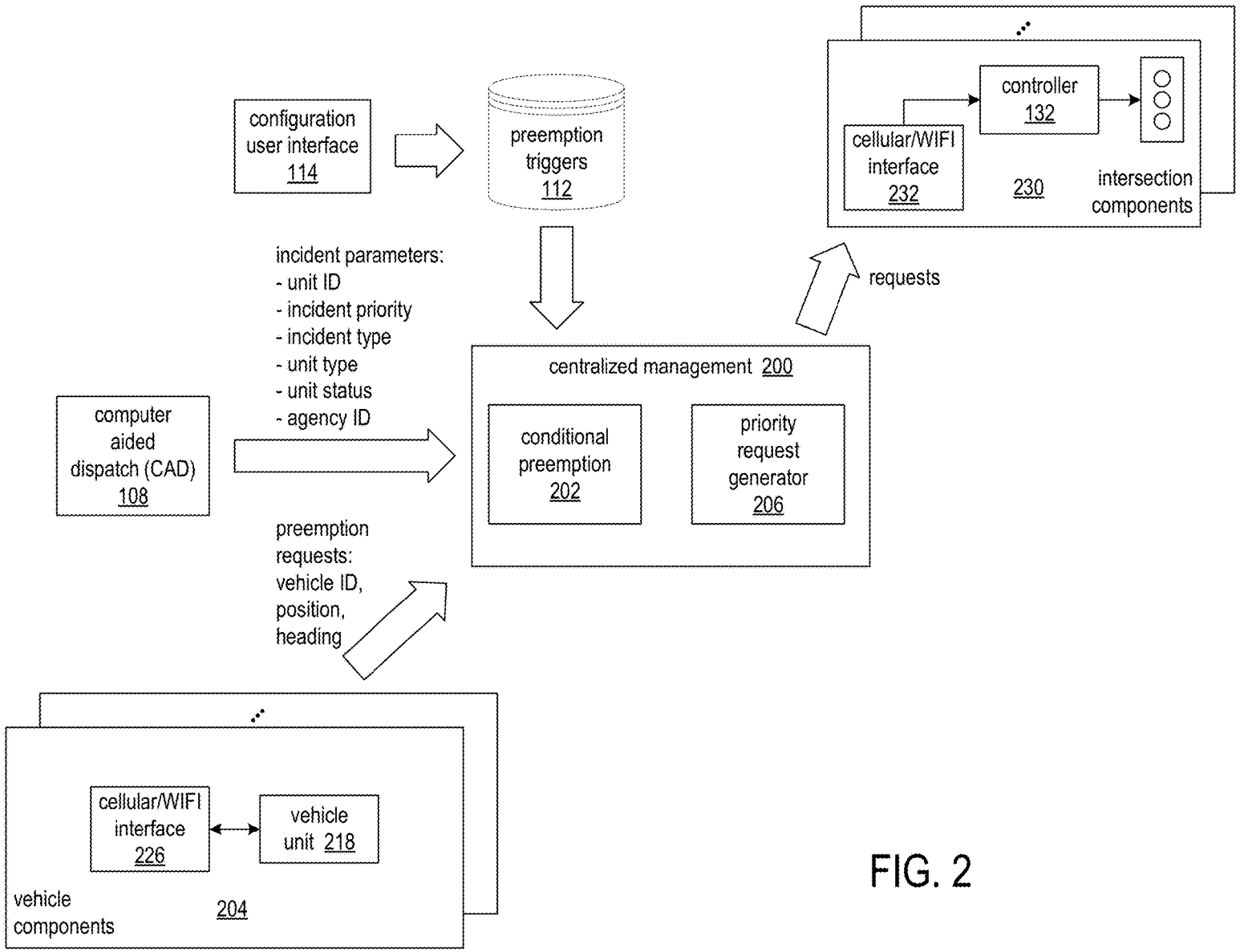
FIG. 2 shows a centralized approach for configuring traffic signal preemption modes of vehicles based on incident parameters.

FIG. 2 shows a centralized approach for configuring traffic signal preemption modes of vehicles based on incident parameters. In the centralized approach, the configuration of preemption modes of vehicles is maintained by the centralized management system 200 rather than at the vehicles, and the centralized management system determines whether or not to issue preemption requests to intersections.

In response to receiving an incident report from the CAD system 108, the conditional preemption module 202 evaluates the values of the incident parameters against the preemption triggers 112. In response to a preemption trigger matching the combination of incident parameter values, the conditional preemption module associates the preemption mode of the trigger with the vehicle identified by the incident report. The associations between vehicles and preemption modes can be maintained in a table stored in memory of the centralized management system, for example.

Vehicle data sets are sent from the arrangements of vehicle components 204, and the data sets are provided from the conditional preemption module to the priority request generator 206. The conditional preemption module can receive the vehicle data sets directly from the arrangements of vehicle components or from the CAD system 108. Each vehicle data set can include a vehicle identifier, a position, speed, and a heading.

The priority request generator determines which intersection(s) for which the vehicle is eligible to preempt the traffic signals, such as by comparing the vehicle location and heading to approach maps defined for the intersections. For each intersection for which the vehicle is eligible for preemption, the priority request generator communicates a preemption request to traffic signal control circuitry at the intersection. The request(s) to the intersection specify the preemption mode, which effectively either enables or disables preemption. If the priority request generator determines that the vehicle is not eligible for preemption, the priority request generator sends no request.

In some implementations, the priority request generator can prioritize vehicles competing for preemption at an intersection and select one of the vehicles and generate a preemption to the intersection controller 132 at the intersection. In other implementations, the intersections can have phase selectors that prioritize and select from competing preemption requests, and the priority request generator can send preemption requests to the phase selectors for processing.

In response to a vehicle data set sent from a vehicle unit 218, the conditional preemption module 202 looks-up the preemption mode associated with the vehicle identified in the data set. The conditional preemption module communicates the information from the data set and the preemption mode (e.g., high, probe etc.) to the priority request generator 206. Based on the position and heading information in the data set and approach maps defined for the intersections, the priority request generator determines which intersection(s), if any, to which a request (EVP, TSP, or probe request) should be sent. The priority request generator then communicates the request to the intersection(s) determined to have approach maps that encompass the vehicle. Traffic signal preemption at an intersection is effectively enabled with the priority request generator determining which intersection(s) is in range and the associated preemption mode being high, or some mode other than probe which can cause a change in signal phase. Traffic signal preemption at an intersection is effectively disabled with the priority request generator determining which intersection(s) is in range and the associated preemption mode being probe, or some mode other that cannot cause a change in signal phase.

Each arrangement of vehicle components 204 can include a vehicle unit 218 and interface circuitry 226 that provides a communication channel between the vehicle unit and either the CAD system 108 or the conditional preemption module 202. The interface circuitry 226 can provide a cellular communications interface or a WIFI interface to a city-wide or regional network. The arrangement 204 can further include global positioning system (GPS) modules (not shown).

The intersection components 230 can include interface circuitry 232, which supports a communications channel between the intersection controller 132 and the priority request generator 206. The interface circuitry 232 can provide a cellular communications interface or a WIFI interface to a city-wide or regional network. In some implementations, the priority request generator evaluates and prioritizes preemption requests for instructing the intersection controller 132 to change signal phases. Multiple processes (not shown) executing on the computer system that hosts the centralized management system 200 can implement phase selector functions for associated intersections. In other implementations, the intersection components can include a phase selector (not shown) that evaluates and prioritizes preemption requests, as described above.

Figure 3:
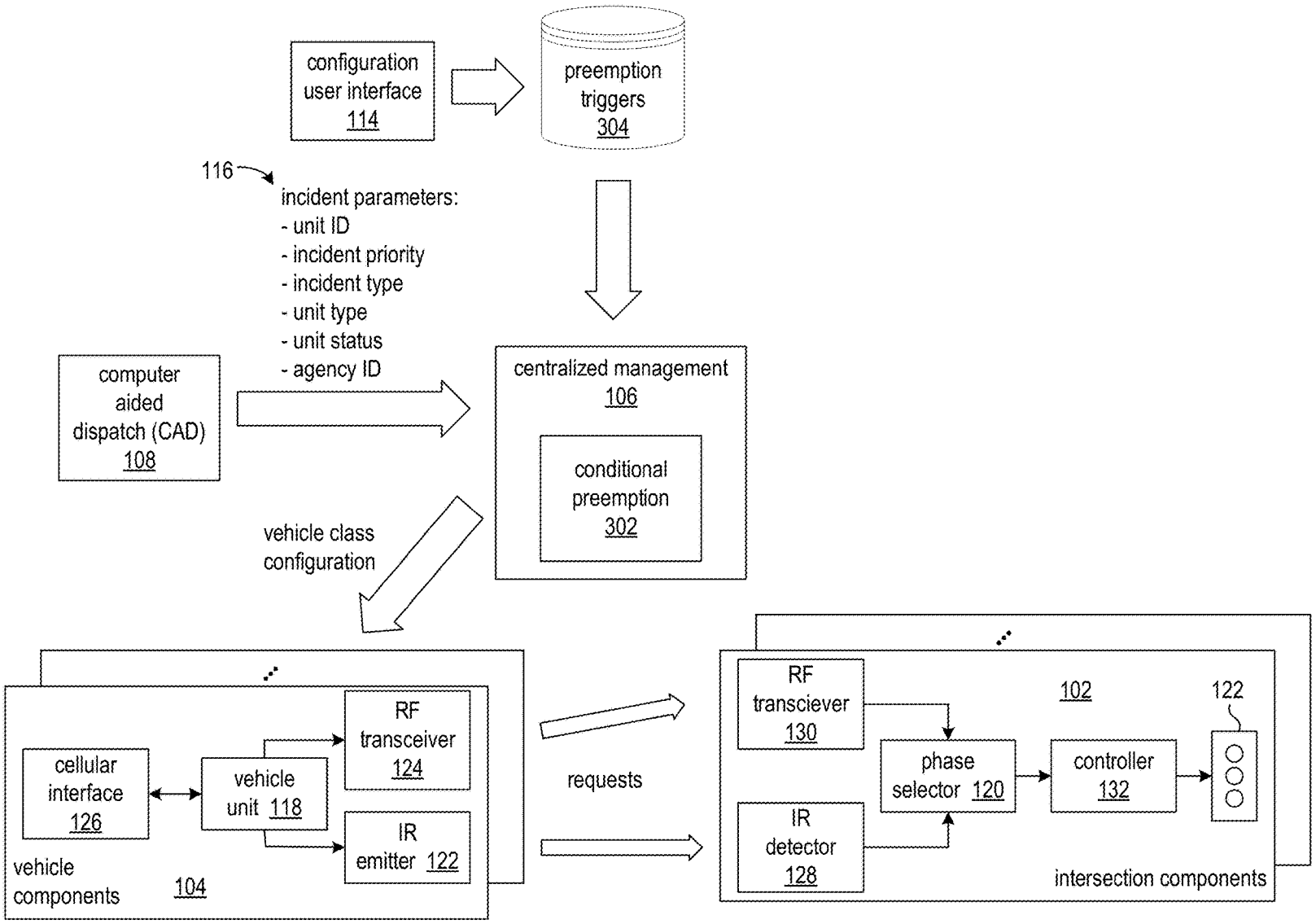
FIG. 3 shows a distributed approach for configuring classifications of vehicles based on incident parameters for controlling traffic signal preemption.
Figure 4:
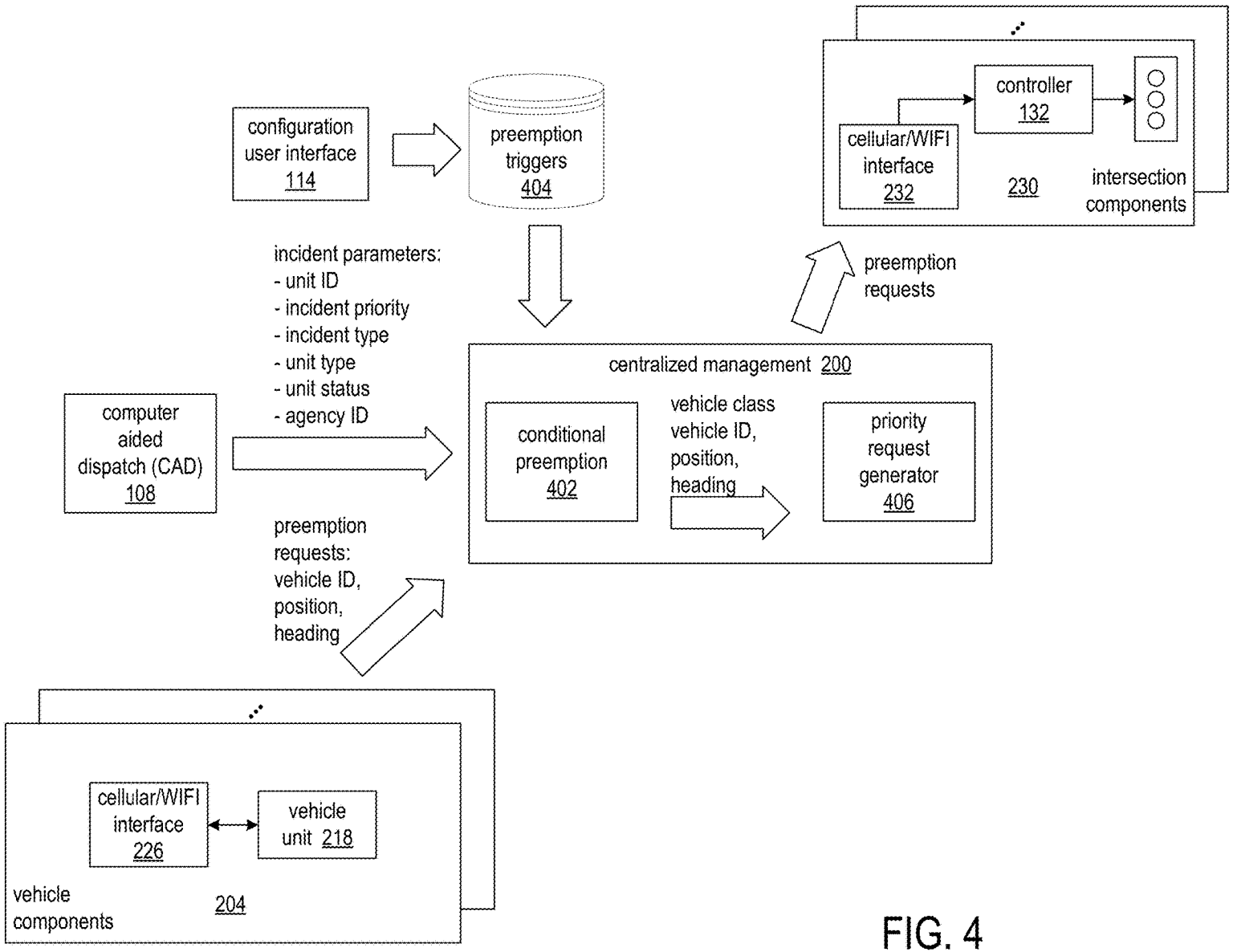
FIG. 4 shows a centralized approach for configuring classifications of vehicles based on incident parameters for controlling traffic signal preemption.

FIGS. 1 and 2 show exemplary approaches in which traffic signal preemption can be enabled and disabled by triggering on incident parameters to configure individual preemption modes for different vehicles. In some systems that support traffic signal preemption, vehicle classifications are used to prioritize preemption requests. FIGS. 3 and 4 show exemplary approaches in which traffic signal preemption can be enabled and disabled by triggering on incident parameters to configure vehicle classifications for different vehicles.

FIG. 3 shows a distributed approach for configuring classifications of vehicles based on incident parameters for controlling traffic signal preemption. The arrangements of vehicle components 104 can be individually configured with a vehicle classification, and the vehicle classification can be dynamically determined and changed based on different incidents occurring at different times.

The desired vehicle classification for an incident can be determined and changed by the conditional preemption module 302, which can be implemented as software that is part of the centralized management system 106. The conditional preemption module 302 can be configured to evaluate incident parameters 116 relative to preemption triggers 304. The preemption triggers can be specified through a configuration user interface 114, which can be a component of the centralized management system. The preemption triggers can specify combinations of incident parameter values that when detected trigger configuration of different vehicle classifications for different vehicles.

In response to receiving an incident report from the CAD system 108, the conditional preemption module 302 evaluates the values of the incident parameters against the preemption triggers 304. In response to a preemption trigger matching the combination of incident parameter values in the incident report, the conditional preemption module communicates a configuration message to the vehicle unit of one of the arrangements of vehicle components 104 as identified by the unit identifier specified in the incident report.

The configuration message can specify a vehicle classification that the vehicle unit 118 stores in a memory and includes in preemption requests to the arrangements of intersection components 102.

The vehicle classification in a preemption request can be used by the phase selector 120 to determine whether or not the vehicle qualifies for preemption based on the vehicle class, location of the vehicle, and heading of the vehicle specified in the preemption request, and to prioritize requests from different vehicles. For example, the classes of vehicles can include police, fire, EMT, and transit. If a fire vehicle and a transit vehicle have both transmitted preemption requests from different approaches to the same intersection, the phase selector can preempt the traffic signals at the intersection in favor of the fire vehicle over the transit vehicle. The phase selector communicates phase selection signals to traffic signal controller 132 in response to determining that the vehicle qualifies for preemption at the intersection.

The disclosed features may be useful to dynamically increase or decrease the relative preemption priorities given to vehicles for different incidents. As an alternative to the distributed approach to configuring vehicle classifications as shown in FIG. 3, the vehicle classifications can be centrally managed.

FIG. 4 shows a centralized approach for configuring classifications of vehicles based on incident parameters for controlling traffic signal preemption. In the centralized approach, the configuration of vehicle classifications is maintained by the centralized management system 200 rather than at the vehicles. The centralized management system can determine whether or not to issue preemption requests to intersections.

In response to receiving an incident report from the CAD system 108, the conditional preemption module 402 evaluates the values of the incident parameters against the preemption triggers 404. In response to a preemption trigger matching the combination of incident parameter values, the conditional preemption module associates the vehicle classification of the trigger with the vehicle identified by the incident report. The associations between vehicles and vehicle classifications can be maintained in a table stored in memory of the centralized management system, for example.

Vehicle data sets are sent from the arrangements of vehicle components 204, and the data sets are provided from the conditional preemption module 402 to the priority request generator 406. The conditional preemption module can receive the vehicle data sets directly from the arrangements of vehicle components or from the CAD system 108. Each vehicle data set can include a vehicle identifier, a position, and a heading.

In response to a vehicle data set sent from a vehicle unit 218, the conditional preemption module 402 looks-up the vehicle classification associated with the vehicle identified in the data set. The conditional preemption module communicates the information from the vehicle data set and the vehicle classification to the priority request generator 406. Based on the position, speed, and heading information in the vehicle data set and approach maps defined for the intersections, the priority request generator determines which intersection(s), if any, to which a request (EVP, TSP, or probe request) should be sent. The priority request generator prioritizes requests according to the vehicle classification.

The vehicle classification indicates to the priority request generator how a preemption request for that vehicle is to be prioritized. For example, a police vehicle can transmit a vehicle data set, and ordinarily an EVP level preemption request would be generated based on a static vehicle classification. However, with the dynamic vehicle classification approach, the vehicle data set from a police vehicle can be prioritized at the same level as a vehicle data set from a transit vehicle depending on the configured classification. Alternatively, EVP level preemption requests can always have priority over TSP requests, with adjusted vehicle classifications used to control priority between competing EVP requests. The priority request generator communicates a preemption/priority request to the intersection(s) determined to have approach maps that encompass the vehicle.

Multiple processes (not shown) executing on the computer system that hosts the centralized management system 200 can implement phase selector functions for associated intersections. In other implementations, the intersection components 230 can include a phase selector (not shown) that evaluates and prioritizes preemption requests, as described above.

Figure 5:
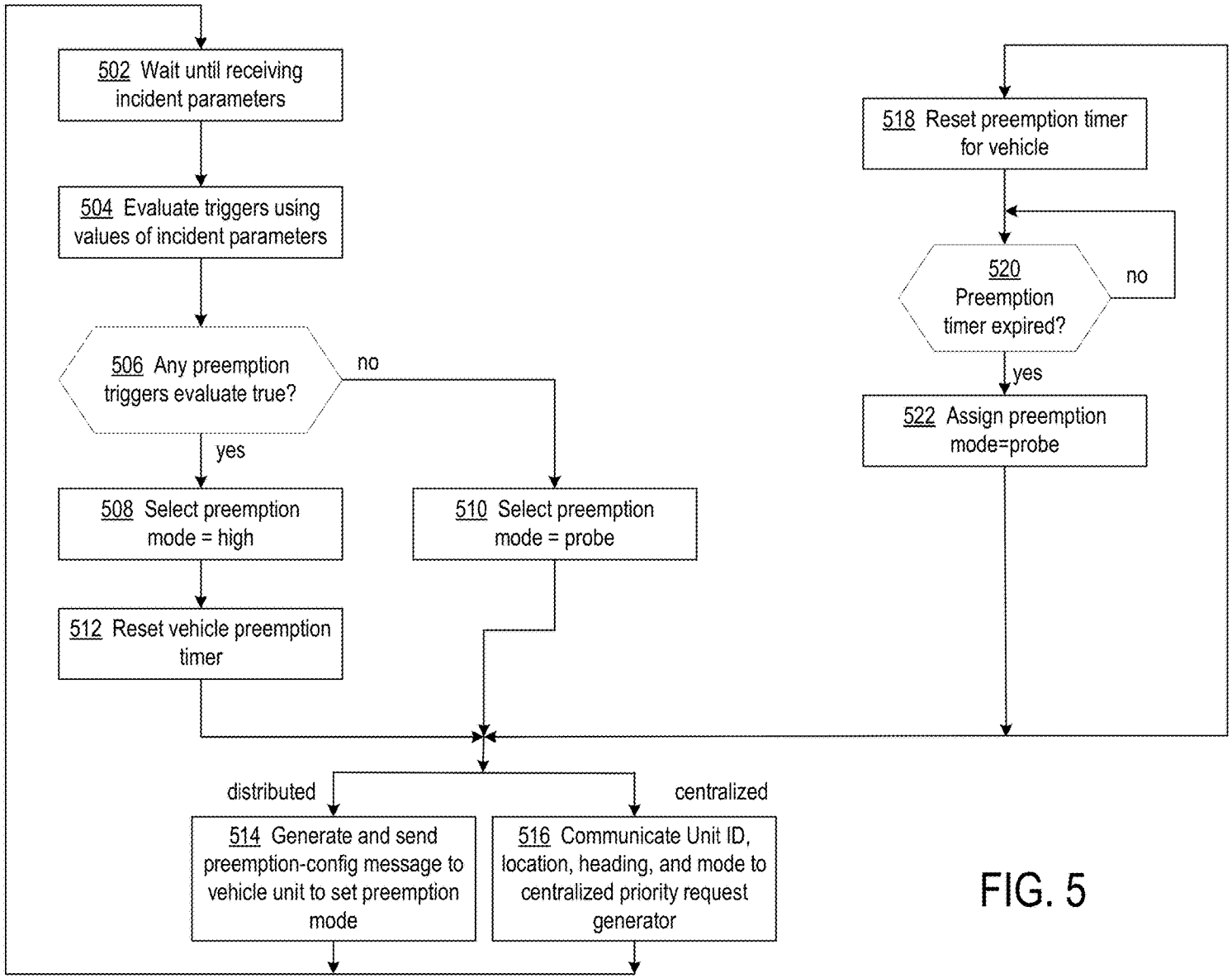
FIG. 5 shows a flowchart of exemplary processes for configuring traffic signal preemption modes of vehicles based on incident parameters.

FIG. 5 shows a flowchart of exemplary processes for configuring traffic signal preemption modes of vehicles based on incident parameters. At block 502, the conditional preemption module receives an incident report that has parameter values that describe the incident and identify a dispatched vehicle. The parameters include at least an incident priority that describes an incident and a vehicle unit identifier of a vehicle unit, which is aboard a vehicle dispatched to the incident.

At block 504, the conditional preemption module determines a preemption mode for the vehicle associated with the vehicle unit identifier. The conditional preemption module evaluates the preemption triggers, which use one or more of the incident parameter values. According to an exemplary approach, the default preemption mode of a vehicle is probe mode, and if a trigger matches the incident parameter values, the preemption mode is changed to high. In an alternative approach, each preemption trigger can specify a preemption mode to allow for more preemption modes than high and probe. In an exemplary approach, each preemption trigger is a Boolean expression referencing incident parameters and values, and if the expression evaluates the true, the preemption trigger is deemed to match the parameter values.

At decision block 506, the conditional preemption circuit determines whether or not any of the preemption triggers evaluated to true. If so, at block 508 the high preemption mode is selected, which effectively enables traffic signal preemption for the vehicle unit once the mode is configured. Otherwise, at block 510 the probe preemption mode is selected, which effectively disables traffic signal preemption for the vehicle unit when the mode is so configured. In approaches involving more than high and probe modes, at block 508 the preemption mode specified by the preemption trigger can be selected as the preemption mode.

A timer can be used to limit the duration for which preemption is enabled for a vehicle. A timer can be associated with each vehicle. At block 512, if the preemption mode is set to high, the timer is reset. Blocks 518, 520, and 522 show the processing associated with a timer.

For a distributed approach as exemplified in FIG. 1, at block 514, the conditional preemption module generates and sends a configuration message to the vehicle unit identified by incident parameters. For a centralized approach as exemplified in FIG. 2, at block 516 the conditional preemption module communicates vehicle information (unit identifier, location, and heading when a preemption request is received from a vehicle) and the mode to the priority request generator. For the centralized approach, probe requests need not be sent to the intersection, though the requests can be useful for logging. In one implementation, as the vehicle approaches the intersection the mode can be high, and when the vehicle reaches some point within the approach to the intersection the mode can be transitioned to probe.

At block 518, the timer is reset, and decision block 520 repeats until the timer expires. In an exemplary implementation, the configured preemption mode (e.g., high) of a vehicle unit remains for 10 minutes if no further requests are received to reset the timer. Once the timer expires, at block 522 the preemption mode is assigned probe, and the vehicle unit is configured with the probe mode according to one of blocks 514 or 516.

Figure 6:
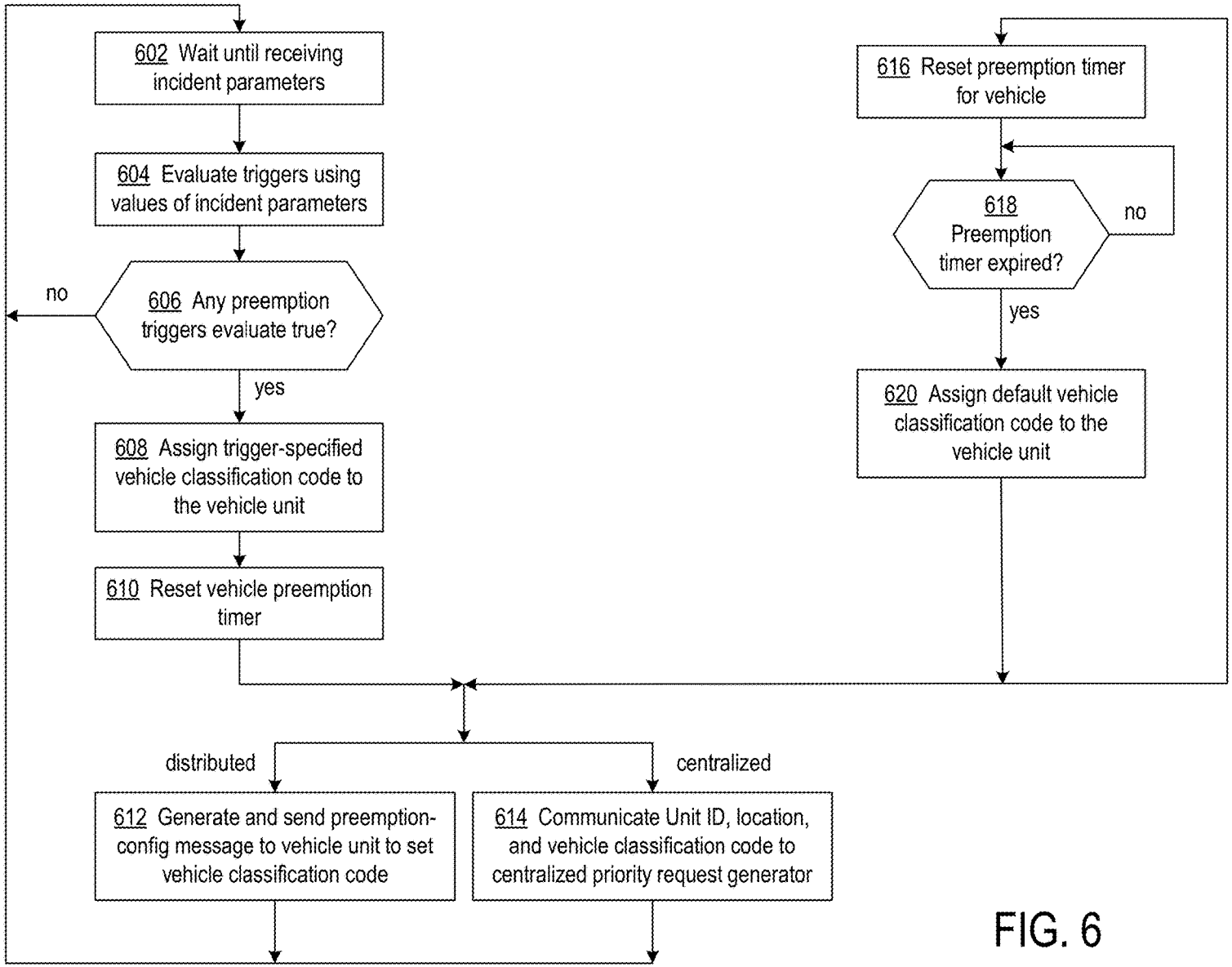
FIG. 6 shows a flowchart of exemplary processes for configuring classifications of vehicles based on incident parameters for controlling traffic signal preemption.

FIG. 6 shows a flowchart of exemplary processes for configuring classifications of vehicles based on incident parameters for controlling traffic signal preemption.

At block 602, the conditional preemption module receives an incident report that has parameter values that describe the incident and identify a dispatched vehicle. The parameters include at least an incident priority that describes an incident and a vehicle unit identifier of a vehicle unit, which is aboard a vehicle dispatched to the incident.

At block 604, the conditional preemption module determines a vehicle classification for the vehicle associated with the vehicle unit identifier. The conditional preemption module evaluates the preemption triggers, which use one or more of the incident parameter values. According to an exemplary approach, the default vehicle classification of a vehicle can be a vehicle classification having the lowest preemption priority, and if a trigger matches the incident parameter values, the vehicle classification is changed to the vehicle classification having the highest preemption priority. In an alternative approach, each preemption trigger can specify a vehicle classification to allow for more vehicle classifications than highest and lowest preemption priorities. In an exemplary approach, each preemption trigger is a Boolean expression referencing incident parameters and values, and if the expression evaluates the true, the preemption trigger is deemed to match the parameter values.

At decision block 606, the conditional preemption circuit determines whether or not any of the preemption triggers evaluated to true. If so, at block 608 the vehicle classification code is assigned to the identified vehicle unit, which can effectively enable or disable traffic signal preemption for the vehicle unit once the vehicle classification is configured. Otherwise, the process returns to block 602 to wait for the next incident report.

A timer can be used to limit the duration for which preemption is enabled for a vehicle. A timer can be associated with each vehicle. At block 610, if a preemption trigger evaluated to true, the timer is reset. Blocks 616, 618, and 620 show the processing associated with a timer.

For a distributed approach as exemplified in FIG. 3, at block 612, the conditional preemption module generates and sends a configuration message to the vehicle unit identified by incident parameters. For a centralized approach as exemplified in FIG. 4, at block 614 conditional preemption module communicates vehicle information (unit identifier, location, and heading when a preemption request is received from a vehicle) and the vehicle classification to the priority request generator.

At block 616, the timer is reset, and decision block 618 repeats until the timer expires. In an exemplary implementation, the configured vehicle classification of a vehicle unit remains for 10 minutes if no further requests are received to reset the timer. Once the timer expires, at block 522 the vehicle classification is assigned the default vehicle classification, and the vehicle unit is configured with the default vehicle classification according to one of blocks 612 or 614.

Figure 7:
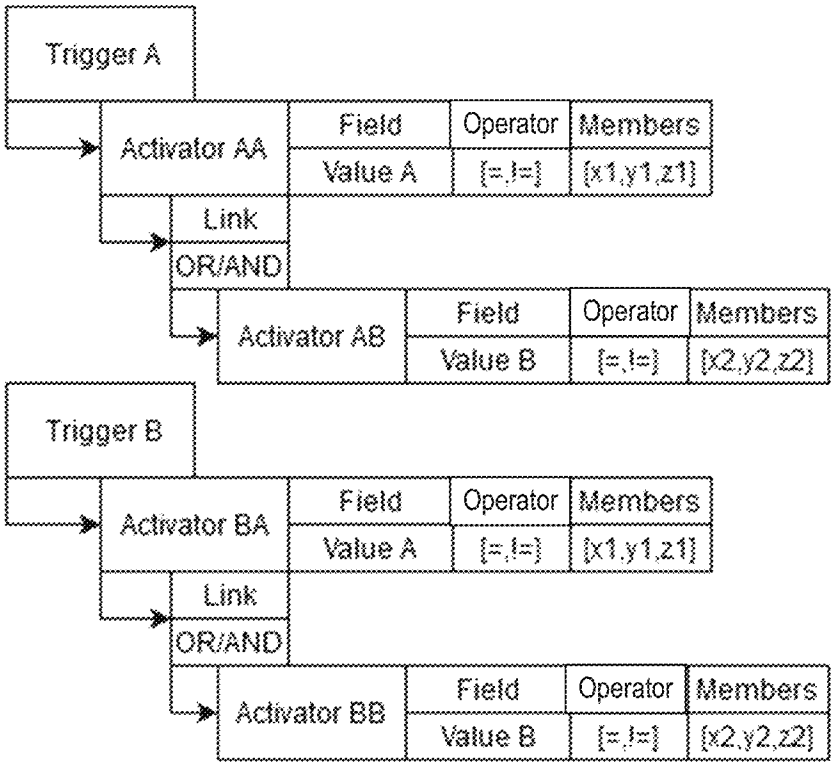
FIG. 7 shows an exemplary data structure for specification of preemption triggers.

FIG. 7 shows an exemplary data structure for specification of preemption triggers. Trigger A and Trigger B are examples of two preemption triggers. Each trigger can include one or more activators that together specify a Boolean expression. Multiple activators can be linked by an AND or an OR operator (or "link"). Each activator specifies one of the incident parameters ("field"), an operator (equal to or not equal to), and one or more values ("members").

Trigger A is shown as having two activators, "AA" and "AB," and trigger B is shown has having two activators, "BA" and "BB." Though the exemplary triggers each have two activators, an activator can have N activators for N≥1.

The field of an activator can be any of the parameters of an incident report, such as the exemplary unit identifier, incident priority, incident type, unit type, unit status, and agency identifier. The member(s) in an activator can be any value deemed by system management personnel to be relevant. Examples of members for the fields are those parameter values described above for the unit identifier, incident priority, incident type, unit type, unit status, and agency identifier.

An activator evaluates to true if the parameter value in the incident report matches any of the specified members, with a match being defined by the specified operator (= or !=). According to one implementation, activators in a trigger are not grouped when evaluating. Thus, using a combination of AND links and OR links between activators in a trigger should be avoided. Instead, separate triggers can be used to detect the desired alternative trigger conditions.

Figure 8:
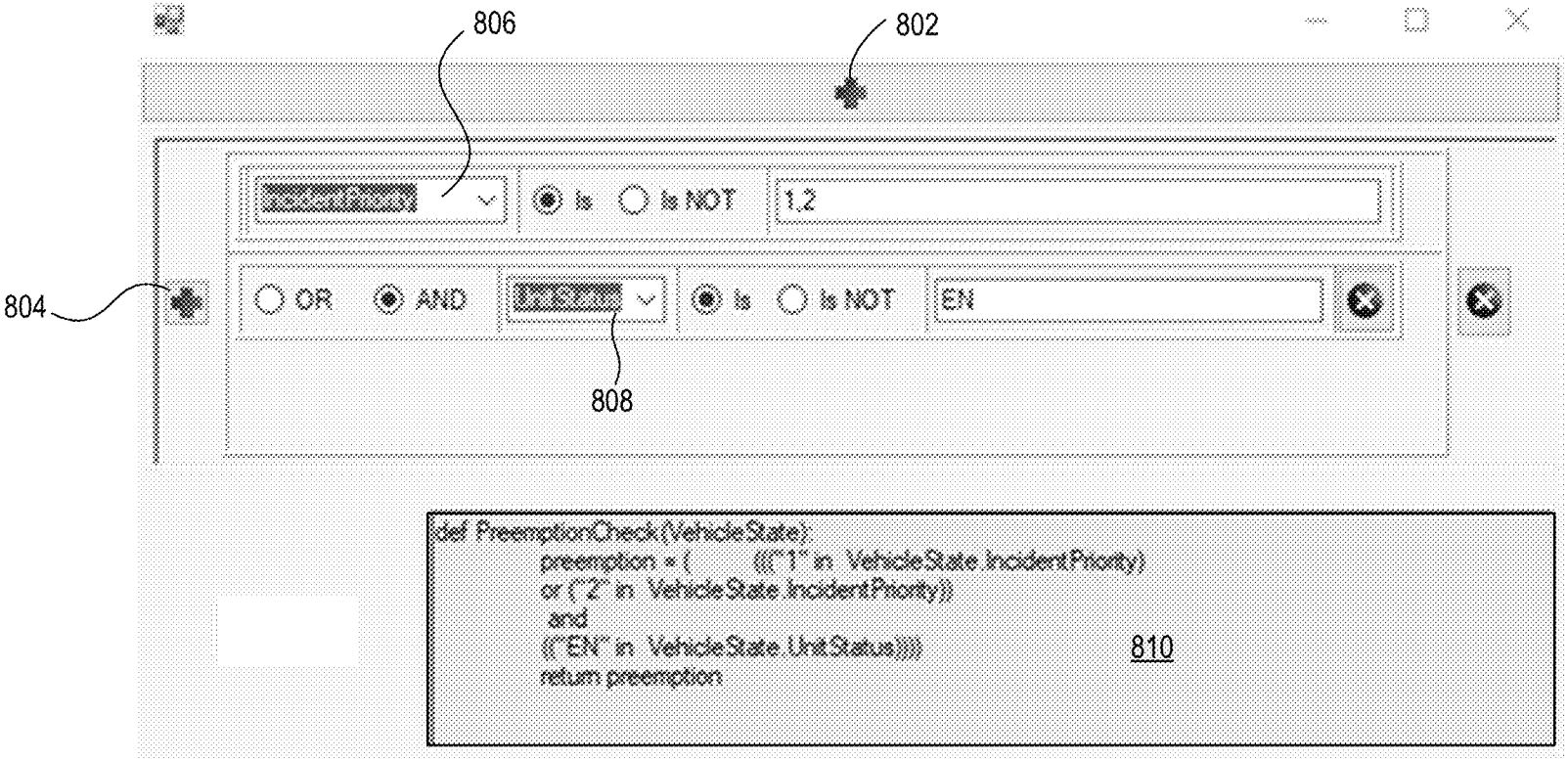
FIG. 8 shows an exemplary user interface for specifying preemption triggers consistent with the exemplary data structure of FIG. 7.

FIG. 8 shows an exemplary user interface for specifying preemption triggers consistent with the exemplary data structure of FIG. 7.

A preemption trigger can be created by selecting the plus button 802. An activator can be created in the trigger by selecting the plus button 804. The exemplary preemption trigger has two activators linked by an AND operator. The first activator specifies the "IncidentPriority" parameter as the field 806 of the activator, and a pull-down menu can be used to select parameter. The specified operator of the activator is equal-to, which in the user interface is shown as the "Is." The "Is NOT" option can be used to specify a not-equal-to operator. The specified members of the activator are the values 1 and 2.

The second activator specifies the "UnitStatus" parameter as the field 808. The specified operator is equal-to, and the member is "EN," which can be the parameter value that indicates that the Unit Status is enabled.

Box 810 of the user interface shows the programmatic specification resulting from the GUI specification of the preemption trigger Various blocks, modules, devices, systems, units, controllers, generators or engines can be implemented to carry out one or more of the operations and activities described herein and/or shown in the figures. In these contexts, a block, module, device, system, unit, generator, or controller is a circuit that carries out one or more of the disclosed or related operations/activities. For example, in certain of the above-discussed implementations, one or more blocks, modules, devices, systems, units, generators or controllers are discrete logic circuits or programmable circuits configured and arranged for implementing these operations/activities. The programmable circuitry can be one or more computer circuits programmed to execute a set (or sets) of instructions (and/or configuration data). The instructions (and/or configuration data) can be in the form of firmware or software stored in and accessible from a memory (circuit).

Some implementations are directed to a computer program product (e.g., nonvolatile memory device), which includes a machine or computer-readable medium having stored thereon instructions which may be executed by a computer (or other electronic device) to perform these operations/activities.

Though aspects and features may in some cases be described in individual figures, it will be appreciated that features from one figure can be combined with features of another figure even though the combination is not explicitly shown or explicitly described as a combination.

The embodiments are thought to be applicable to a variety of systems for controlling traffic signal phases. Other aspects and embodiments will be apparent to those skilled in the art from consideration of the specification. The embodiments may be implemented as one or more processors configured to execute software, as an application specific integrated circuit (ASIC), or as a logic on a programmable logic device. It is intended that the specification and illustrated embodiments be considered as examples only, with a true scope of the invention being indicated by the following claims.

What is claimed is:

1. A method, comprising:

inputting to a conditional preemption circuit, values of a plurality of incident parameters that include at least a vehicle unit identifier of a vehicle unit and an incident priority that describes an incident;

determining by the conditional preemption circuit, a vehicle class based on one or more of the plurality of incident parameters;

determining in response to a preemption request communicated from the vehicle unit, whether or not the vehicle unit qualifies for preemption at one or more intersections based at least on the vehicle class, location of the vehicle, and heading of the vehicle unit specified in the preemption request; and communicating phase selection signals to traffic signal control circuitry at the one or more intersections in response to determining that the vehicle unit qualifies for preemption at the one or more intersections.

2. The method of claim 1, further comprising:

generating a configuration message that specifies a vehicle priority classification code for the vehicle priority class by the conditional preemption circuit;

transmitting the configuration message from the conditional preemption circuit to the vehicle unit;

configuring the vehicle unit to operate with the vehicle priority classification code specified in the configuration message;

transmitting the preemption request having the vehicle priority classification code by the vehicle unit; and wherein the determining includes determining by respective one or more of a plurality of phase selector circuits at the one or more intersections that the vehicle unit qualifies for traffic signal preemption.

3. The method of claim 1, wherein the determining whether or not the vehicle unit qualifies for preemption includes determining whether or not the vehicle unit qualifies for preemption at the one or more intersections by one or more processes executing on a centralized data processing system and functioning as respective phase selectors for the one or more intersections.

4. The method of claim 1, wherein the determining the vehicle class includes evaluating a plurality of trigger conditions, each trigger condition references one or more of the plurality of incident parameters, and the evaluating determines the vehicle class in response to any of the trigger conditions evaluating to true.

5. The method of claim 4, wherein:

the one or more of the plurality of incident parameters include an incident type, and the value of the incident type indicates one of an alarm, a burglary, a crash, a disturbance, a domestic dispute, a fire, a hazardous materials emergency, or a medical emergency;

the evaluating of the plurality of trigger conditions determines the vehicle class to be a first vehicle class in response to the incident type having a first value; and the evaluating of the plurality of trigger conditions determines the vehicle class to be a second vehicle class in response to the incident type having a second value.

6. The method of claim 4, wherein:

the one or more of the plurality of incident parameters include a vehicle unit status, and the value of the vehicle unit status indicates one of available, unavailable, dispatched, in-route, on-scene, or off-duty;

the evaluating of the plurality of trigger conditions determines the vehicle class to be a first vehicle class in response to the vehicle unit status having a first value; and the evaluating of the plurality of trigger conditions determines the vehicle class to be a second vehicle class in response to the vehicle unit status having a second value.

7. The method of claim 4, wherein:

the one or more of the plurality of incident parameters include a vehicle unit type, and the value of the vehicle unit type indicates one of and animal-carrying vehicle, a detective vehicle, a patrol vehicle, a fire vehicle, or an emergency medical transport vehicle;

the evaluating of the plurality of trigger conditions determines the vehicle class to be a first vehicle class in response to the vehicle unit type having a first value; and the evaluating of the plurality of trigger conditions determines the vehicle class to be a second vehicle class in response to the vehicle unit type having a second value.

8. The method of claim 1, wherein:

the plurality of incident parameters include an incident type, a vehicle unit status, and a vehicle unit type;

the determining the vehicle class includes evaluating a plurality of trigger conditions, each trigger condition references values of one or more of the plurality of incident parameters and at least one trigger condition references two or more of the plurality of incident parameters; and the evaluating determines the vehicle class to be a first vehicle class in response to the at least one trigger condition evaluating to true and determines the vehicle class to be a second vehicle class in response to another of the trigger conditions evaluating to true.

9. A system comprising:

a computer system having one or more processors and memory configured with instructions that when executed cause the one or more processors to perform operations including:

inputting values of a plurality of incident parameters that include at least a vehicle unit identifier of a vehicle unit and an incident priority that describes an incident;

determining a vehicle class based on one or more of the plurality of incident parameters;

determining in response to a preemption request communicated from the vehicle unit, whether or not the vehicle unit qualifies for preemption at one or more intersections based at least on the vehicle class, location of the vehicle, and heading of the vehicle unit specified in the preemption request; and communicating phase selection signals to traffic signal control circuitry at the one or more intersections in response to determining that the vehicle unit qualifies for preemption at the one or more intersections.

10. The system of claim 9, further comprising:

a vehicle unit;

a plurality of phase selector circuits at the one or more intersections;

wherein the memory is configured with instructions that when executed cause the one or more processors to perform operations including:

generating a configuration message that specifies a vehicle priority classification code for the vehicle priority class, and transmitting the configuration message to the vehicle unit;

wherein the vehicle unit is configured to:

operate with the vehicle priority classification code specified in the configuration message, and transmit the preemption request having the vehicle priority classification code; and wherein each of the phase selector circuits is configured to determine whether or not the vehicle unit qualifies for traffic signal preemption.

11. The system of claim 9, wherein the instructions for determining whether or not the vehicle unit qualifies for preemption include instructions for determining whether or not the vehicle unit qualifies for preemption at the one or more intersections by one or more processes functioning as respective phase selectors for the one or more intersections.

12. The system of claim 9, wherein the instructions for determining the vehicle class include instructions for evaluating a plurality of trigger conditions, each trigger condition references one or more of the plurality of incident parameters, and the evaluating determines the vehicle class in response to any of the trigger conditions evaluating to true.

13. The system of claim 12, wherein:

the one or more of the plurality of incident parameters include an incident type, and the value of the incident type indicates one of an alarm, a burglary, a crash, a disturbance, a domestic dispute, a fire, a hazardous materials emergency, or a medical emergency;

the instructions for evaluating of the plurality of trigger conditions determine the vehicle class to be a first vehicle class in response to the incident type having a first value; and the instructions for evaluating of the plurality of trigger conditions determine the vehicle class to be a second vehicle class in response to the incident type having a second value.

14. The system of claim 12, wherein:

the one or more of the plurality of incident parameters include a vehicle unit status, and the value of the vehicle unit status indicates one of available, unavailable, dispatched, in-route, on-scene, or off-duty;

the instructions for evaluating of the plurality of trigger conditions determine the vehicle class to be a first vehicle class in response to the vehicle unit status having a first value; and the instructions for evaluating of the plurality of trigger conditions determine the vehicle class to be a second vehicle class in response to the vehicle unit status having a second value.

15. The system of claim 12, wherein:

the one or more of the plurality of incident parameters include a vehicle unit type, and the value of the vehicle unit type indicates one of and animal-carrying vehicle, a detective vehicle, a patrol vehicle, a fire vehicle, or an emergency medical transport vehicle;

the instructions for evaluating of the plurality of trigger conditions determine the vehicle class to be a first vehicle class in response to the vehicle unit type having a first value; and the instructions for evaluating of the plurality of trigger conditions determine the vehicle class to be a second vehicle class in response to the vehicle unit type having a second value.

16. The system of claim 9, wherein:

the plurality of incident parameters include an incident type, a vehicle unit status, and a vehicle unit type;

the instructions for determining the vehicle class include instructions for evaluating a plurality of trigger conditions, each trigger condition references values of one or more of the plurality of incident parameters and at least one trigger condition references two or more of the plurality of incident parameters; and the instructions for evaluating determine the vehicle class to be a first vehicle class in response to the at least one trigger condition evaluating to true and determines the vehicle class to be a second vehicle class in response to another of the trigger conditions evaluating to true.

* * * * *